US012031419B2

(12) United States Patent
Travis et al.

(10) Patent No.: US 12,031,419 B2
(45) Date of Patent: Jul. 9, 2024

(54) HYDRAULIC FRACTURING FLUID DELIVERING SYSTEM

(71) Applicants: Todd Anthony Travis, Humble, TX (US); Angelica Calzoncinth, Baytown, TX (US); Eric Calzoncinth, Baytown, TX (US)

(72) Inventors: Todd Anthony Travis, Humble, TX (US); Angelica Calzoncinth, Baytown, TX (US); Eric Calzoncinth, Baytown, TX (US)

( * ) Notice: Subject to any disclaimer, the term of this patent is extended or adjusted under 35 U.S.C. 154(b) by 296 days.

(21) Appl. No.: 17/538,859

(22) Filed: Nov. 30, 2021

(65) Prior Publication Data

US 2022/0341304 A1 Oct. 27, 2022

Related U.S. Application Data

(60) Provisional application No. 63/180,000, filed on Apr. 26, 2021.

(51) Int. Cl.

| | |
|---|---|
| ***E21B 43/26*** | (2006.01) |
| ***B01F 7/00*** | (2006.01) |
| ***F16L 41/02*** | (2006.01) |
| ***F16L 41/03*** | (2006.01) |

(52) U.S. Cl.
CPC ..... *E21B 43/2607* (2020.05)

(58) Field of Classification Search
None
See application file for complete search history.

(56) References Cited

U.S. PATENT DOCUMENTS

| | | | | |
|---|---|---|---|---|
| 10,920,555 | B2 * | 2/2021 | Procita | E21B 43/2607 |
| 11,085,266 | B2 * | 8/2021 | Thomeer | E21B 41/00 |
| 11,359,474 | B1 * | 6/2022 | Uhlmer | E21B 43/2607 |
| 2015/0000766 | A1 * | 1/2015 | Arizpe | E21B 43/26 137/561 A |
| 2017/0122060 | A1 * | 5/2017 | Dille | E21B 33/068 |
| 2017/0159654 | A1 * | 6/2017 | Kendrick | F04D 13/12 |
| 2017/0370199 | A1 * | 12/2017 | Witkowski | F04B 23/06 |
| 2018/0187622 | A1 * | 7/2018 | Rudolecky | F01M 11/10 |
| 2018/0187662 | A1 * | 7/2018 | Hill | E21B 17/04 |
| 2019/0383125 | A1 * | 12/2019 | Koricanek | E21B 43/26 |
| 2023/0107300 | A1 * | 4/2023 | Huang | F17D 3/01 137/597 |

* cited by examiner

*Primary Examiner* — Matthew Troutman
*Assistant Examiner* — Douglas S Wood

(57) ABSTRACT

A hydraulic fracturing fluid delivering system includes at least one fracturing fluid delivering unit that is configured with a low-pressure flow line assembly, a high-pressure flow line assembly, and a plurality of cross beams. The plurality of cross beams is evenly spaced along the low-pressure flow line assembly. The plurality of cross beams is welded onto the low-pressure flow line assembly to structurally strengthen the fracturing fluid delivering unit. The high-pressure flow line assembly is positioned atop the plurality of cross beams and mounted to the plurality of cross beams so that the multiple high-pressure flow line assemblies are able to structurally strengthen the hydraulic fracturing fluid delivering system.

13 Claims, 13 Drawing Sheets

HYDRAULIC FRACTURING FLUID DELIVERING SYSTEM

The current application claims a priority to the U.S. Provisional Patent application Ser. No. 63/180,000 filed on Apr. 26, 2021.

FIELD OF THE INVENTION

The present invention is generally related to hydraulic manifold systems in the field of invention of fracturing fluid delivery technology. More specifically, the present invention is a hydraulic fracturing fluid delivering system that improves upon typical traditional trailer and skid missile systems.

BACKGROUND OF THE INVENTION

Typically, monoline missile systems in the field of invention of fracturing fluid delivery technology, comprise three main sub-assemblies. The two main sub-assemblies are a low-pressure manifold system and a high-pressure manifold system. Both the low-pressure manifold system and the high-pressure manifold system are designed to increase the pressure from the low-pressure manifold system to the high-pressure manifold system the header input fluid pressure via series of pumps. The third sub-assembly is a skid sub-assembly. The three sub-assemblies are designed such that the skid sub-assembly maintains structural integrity and stability for the entire monoline missile system. However, it is the objective of the present invention to reduce or eliminate the skid sub-assemblies involved in the existing monoline missile system.

It is an objective of the present invention to provide an integrated and skid-less compact design for monoline missile systems. The present invention reduces the number of sub-assemblies that are traditionally required for a more cost-effective configuration, as well as an increase in productivity. More specifically, a low-pressure assembly of the present invention becomes a structural body so that each fracturing fluid delivering unit can be configured with using two sub-assemblies rather than three sub-assemblies. A high-pressure assembly of the present invention can function as a structural body on its own or in conjunction with the low-pressure sub assembly between multiple fracturing fluid delivering units so that the present invention can be operational. The present invention eliminates the structural skid sub-assembly thus reducing manufacturing cost and the total weight.

DETAIL DESCRIPTIONS OF THE INVENTION

All illustrations of the drawings are for the purpose of describing selected versions of the present invention and are not intended to limit the scope of the present invention.

The present invention is a hydraulic fracturing fluid delivering system that is described as a compact integrated monoline system similar to an existing monoline system, known as a monoline system. Typically, the existing monoline system comprises three main sub-assemblies. A skid sub-assembly, which is intended to function as the structural body to support the weight of the other two sub-assemblies which includes a low-pressure sub-assembly and a high-pressure sub-assembly. Both the low-pressure sub-assembly and the high-pressure sub-assembly work together to move fluid supplied thru the pressurization process. The existing monoline systems are well known and utilized in the industry. Therefore, the present invention is able to focus on a new structural configuration to deliver the fracturing fluid delivery without the skid sub-assembly thus resulting a lighter and more cost-effective hydraulic fracturing fluid delivering system. More specifically, the present invention only utilizes the low-pressure sub-assembly and the high-pressure sub-assembly to move fluid supplied thru the pressurization process but does not contain the skid sub-assembly that is present within the existing monoline system.

Figure 1:
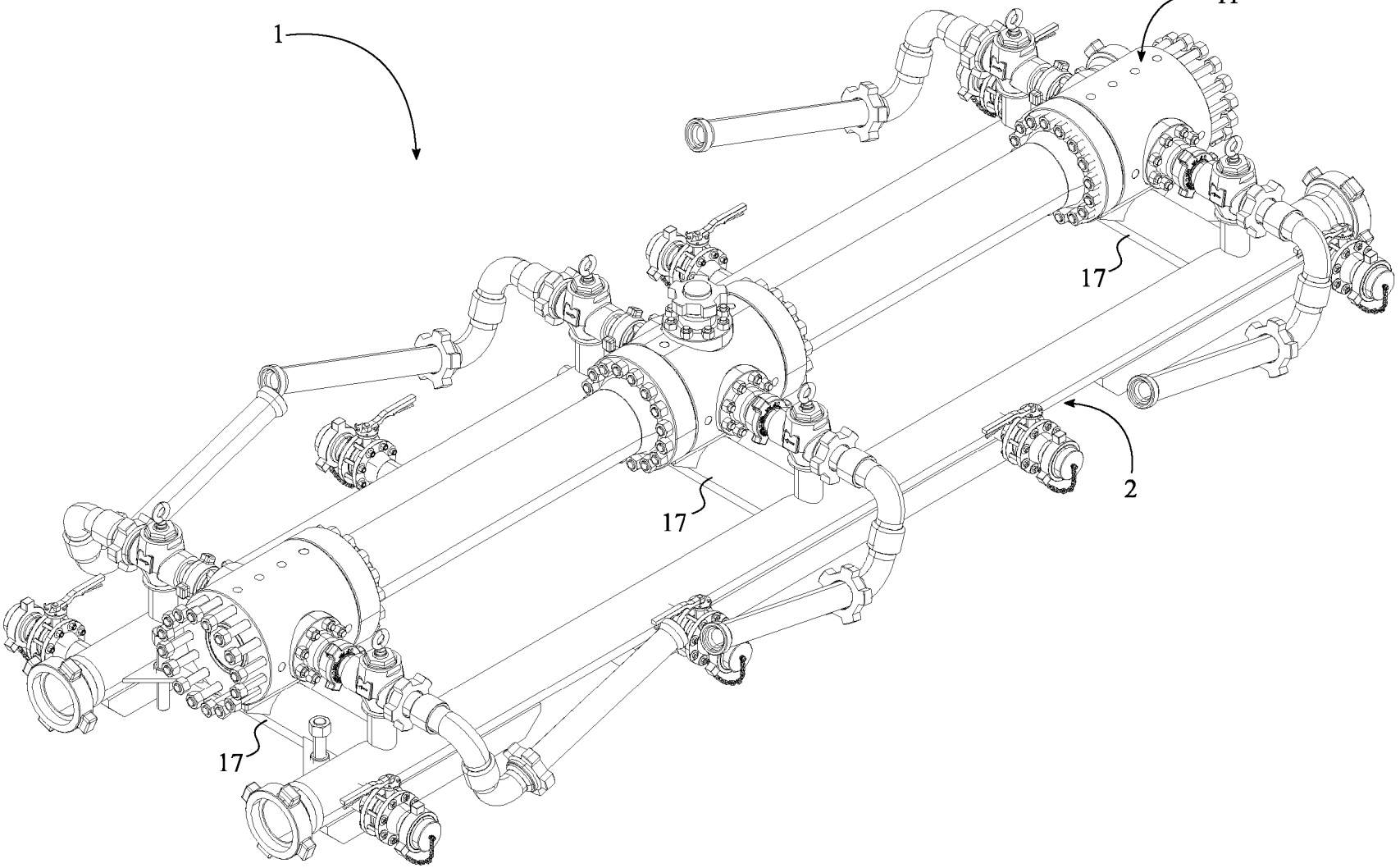
FIG. 1 is a top perspective view of the at least one fracturing fluid delivering unit.
Figure 2:
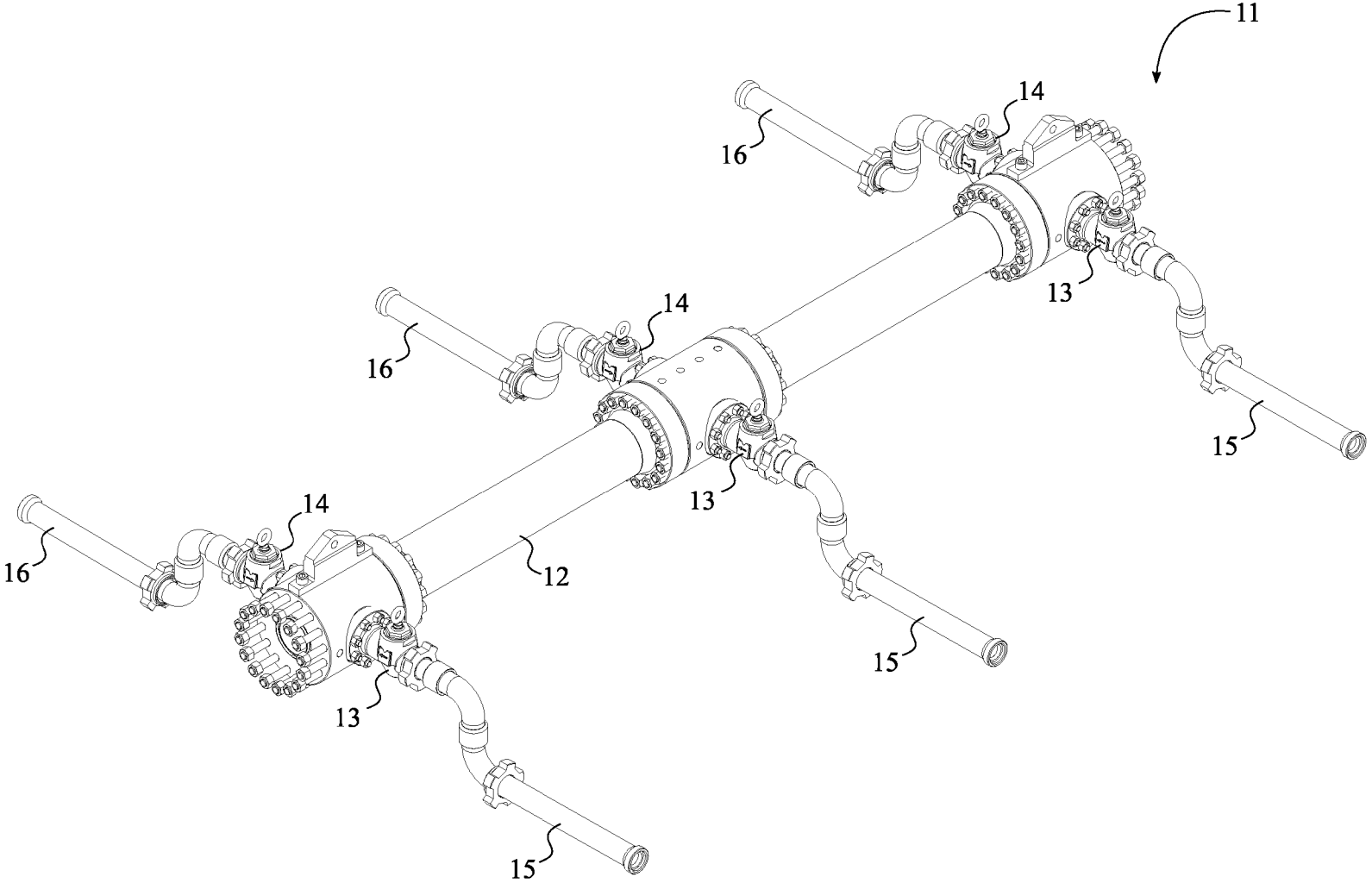
FIG. 2 is a perspective view showing the high-pressure flow line assembly of the at least one fracturing fluid delivering unit.
Figure 3:
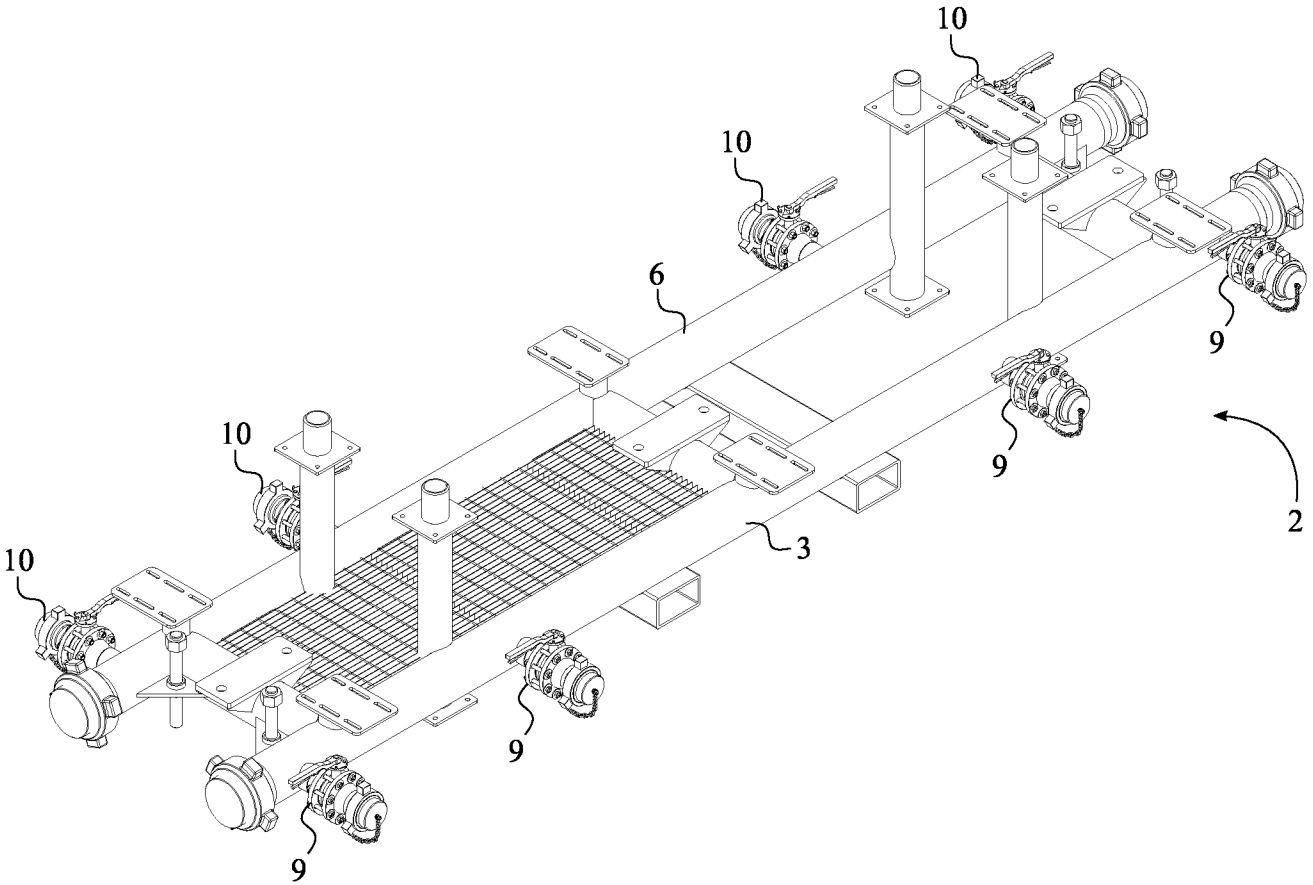
FIG. 3 is a perspective view showing the low-pressure flow line assembly of the at least one fracturing fluid delivering unit.

The present invention is explained in relation to at least one fracturing fluid delivering unit 1 that comprises a low-pressure flow line assembly 2, a high-pressure flow line assembly 11, and a plurality of cross beams 17 as shown in FIG. 1. In reference to the general configuration of the present invention, the plurality of cross beams 17 is evenly spaced along the low-pressure flow line assembly 2 so that the plurality of cross beams 17 can be preferably welded onto the low-pressure flow line assembly 2.

Alternatively, the plurality of cross beams 17 may also be bolted onto the low-pressure flow line assembly. Due to the multiple welded connections between the low-pressure flow line assembly 2 and the plurality of cross beams 17, the low-pressure flow line assembly 2 becomes the structural body for the present invention. Structural elements of the existing monoline system, such as skids, sleds, I-beams, and other supporting members, are eliminated from the present invention thus reducing the manufacturing cost and the total weight. The high-pressure flow line assembly 11 is positioned atop the plurality of cross beams 17 so that the high-pressure flow line can be mounted to the plurality of cross beams 17. The low-pressure flow line assembly 2 facilitates the movement of the hydraulic fracturing fluid from a storage tank to multiple pump trucks so that the hydraulic fracturing fluid can be pressurized. Once, the hydraulic fracturing fluid is pressurized via the pump trucks, the pressurized hydraulic fracturing fluid is then discharged into the high-pressure flow line assembly 11 so that the pressurized hydraulic fracturing fluid can be injected into the wellhead to initiate the hydraulic fracturing.

The low-pressure flow line assembly 2 moves the hydraulic fracturing fluid from the storage tank to the multiple pump trucks so that the hydraulic fracturing fluid can be pressurized. In reference to FIG. 3-7, the low-pressure flow line assembly 2 comprises a left pipe 3, a right pipe 6, a plurality of left outlets 9, and a plurality of right outlets 10. More specifically, the plurality of cross beams 17 is positioned parallel and offset from each other to evenly distribute the weight of the high-pressure flow line assembly 11 and the structurally strengthen the left pipe 3 onto the right pipe 6. The left pipe 3 is positioned perpendicular to the plurality of cross beams 17 so that the plurality of cross beams 17 can be terminally welded (or bolted) onto the left pipe 3. The right pipe 6 is positioned perpendicular to the plurality of cross beams 17 so that the plurality of cross beams 17 can be terminally welded (or bolted) onto the right pipe 6, opposite of the left pipe 3. In order to pressurize the hydraulic fracturing fluid, a first set of pump trucks is positioned adjacent to the left pipe 3 and a second set of pump trucks is positioned adjacent to the right pipe 6. As a result, the left pipe 3 enables the hydraulic fracturing fluid to move from the storage tank to the first set of pump trucks. More specifically, the plurality of left outlets 9 is integrated into the left pipe 3 and is in fluid communication with the left pipe 3 so that the first set of pump trucks can be coupled to the left pipe 3 via the plurality of left outlets 9. The right pipe 6 enables the hydraulic fracturing fluid to move from the storage tank to the second set of pump trucks. More specifically, the plurality of right outlets 10 is integrated into the right pipe 6 and is in fluid communication with the right pipe 6 so that the second set of pump trucks can be coupled to the right pipe 6 via the plurality of right outlets 10.

Figure 4:
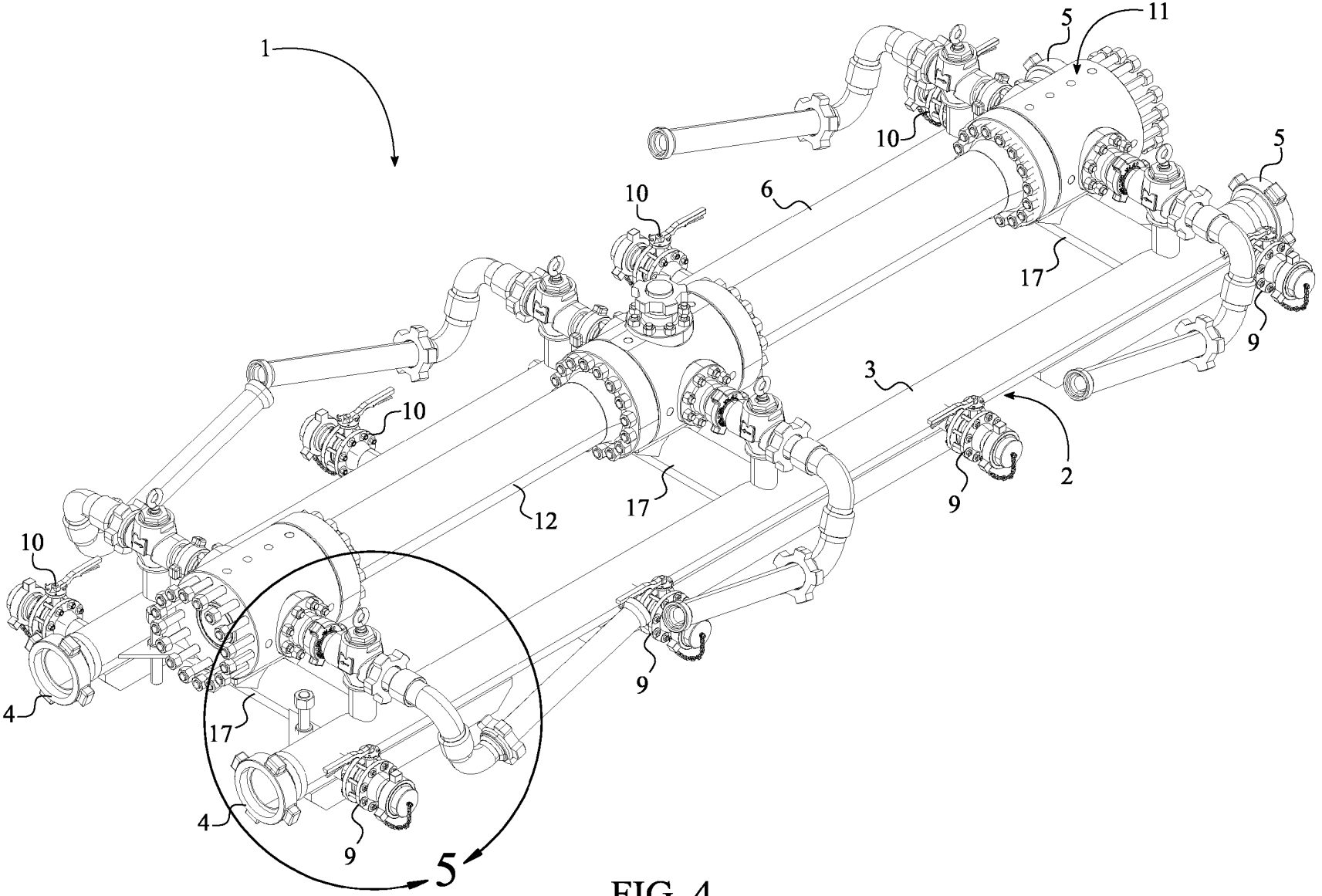
FIG. 4 is top left perspective view of the at least one fracturing fluid delivering unit, showing the sections that a detailed view is taken shown in FIG. 5.
Figure 5:
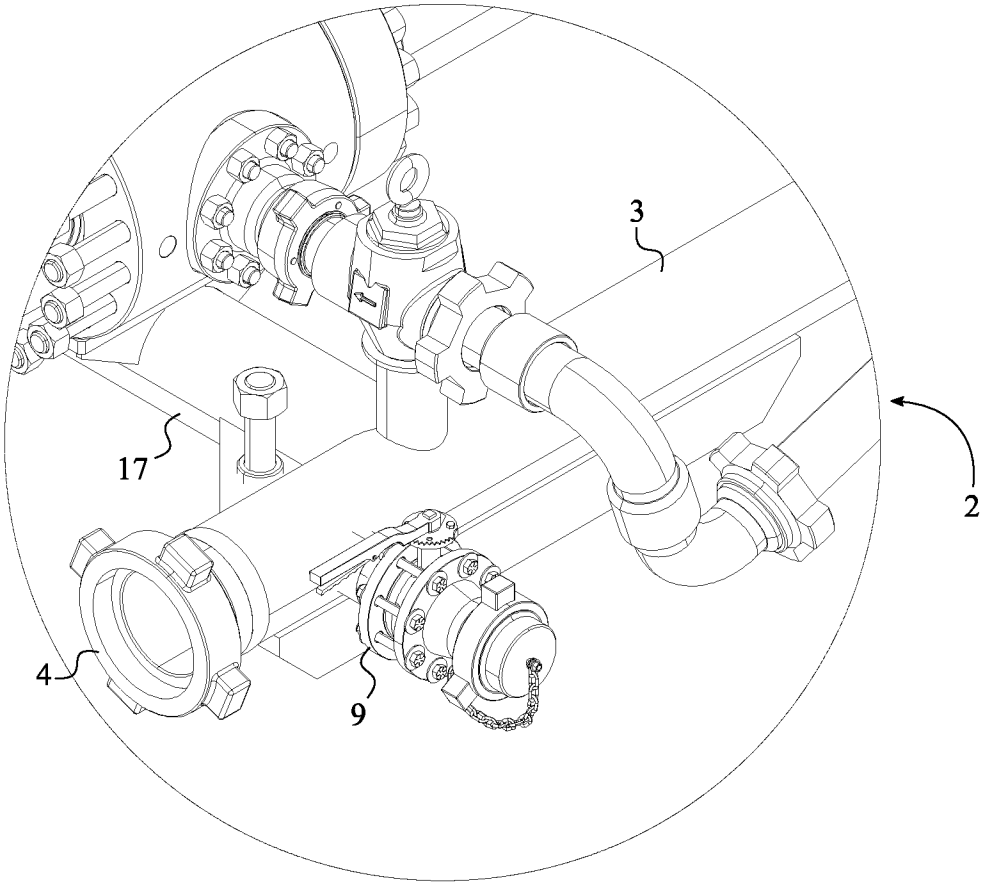
FIG. 5 is a detailed view of the left pipe of the at least one fracturing fluid delivering unit.
Figure 6:
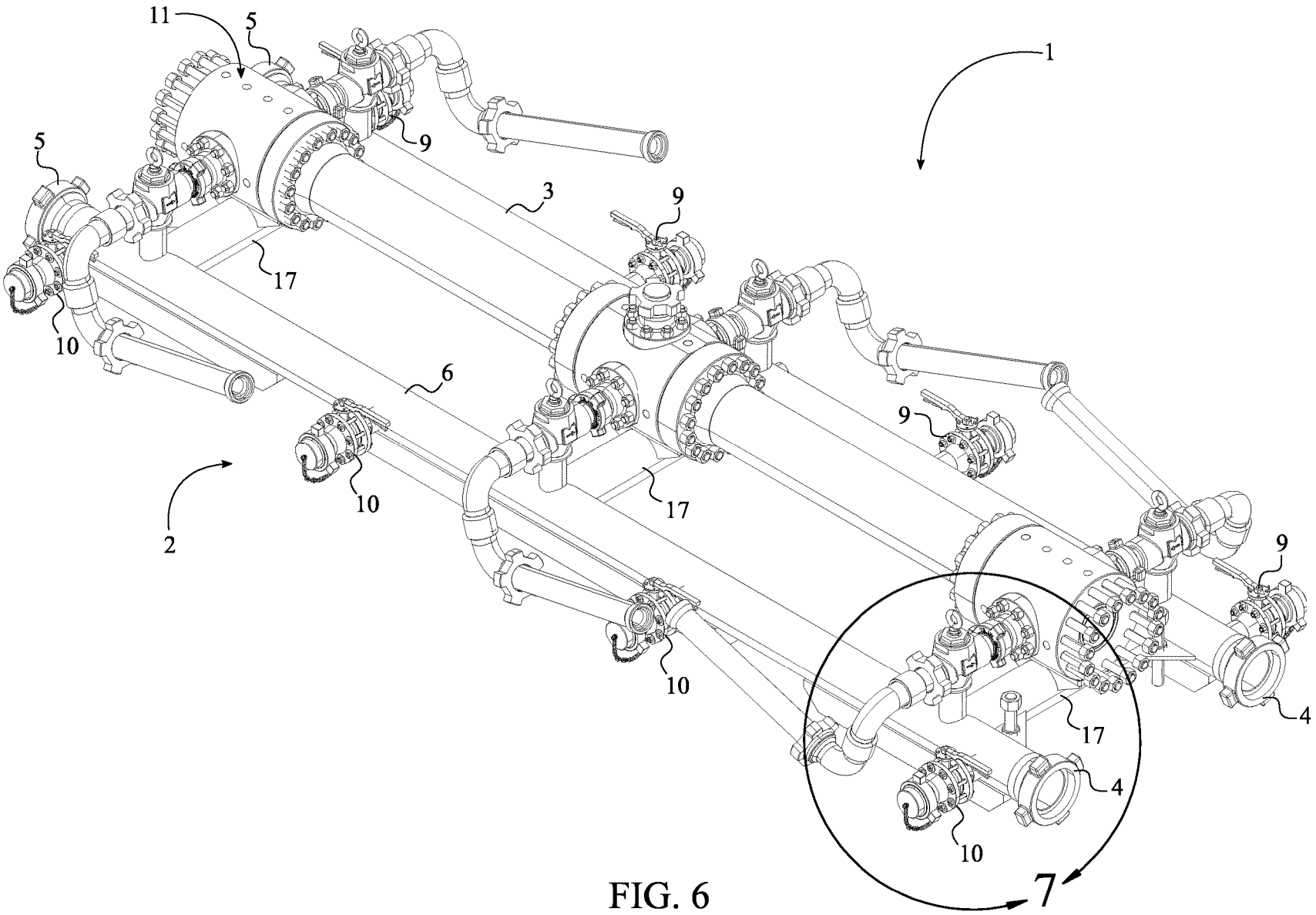
FIG. 6 is top right perspective view of the at least one fracturing fluid delivering unit, showing the sections that a detailed view is taken shown in FIG. 7.
Figure 7:
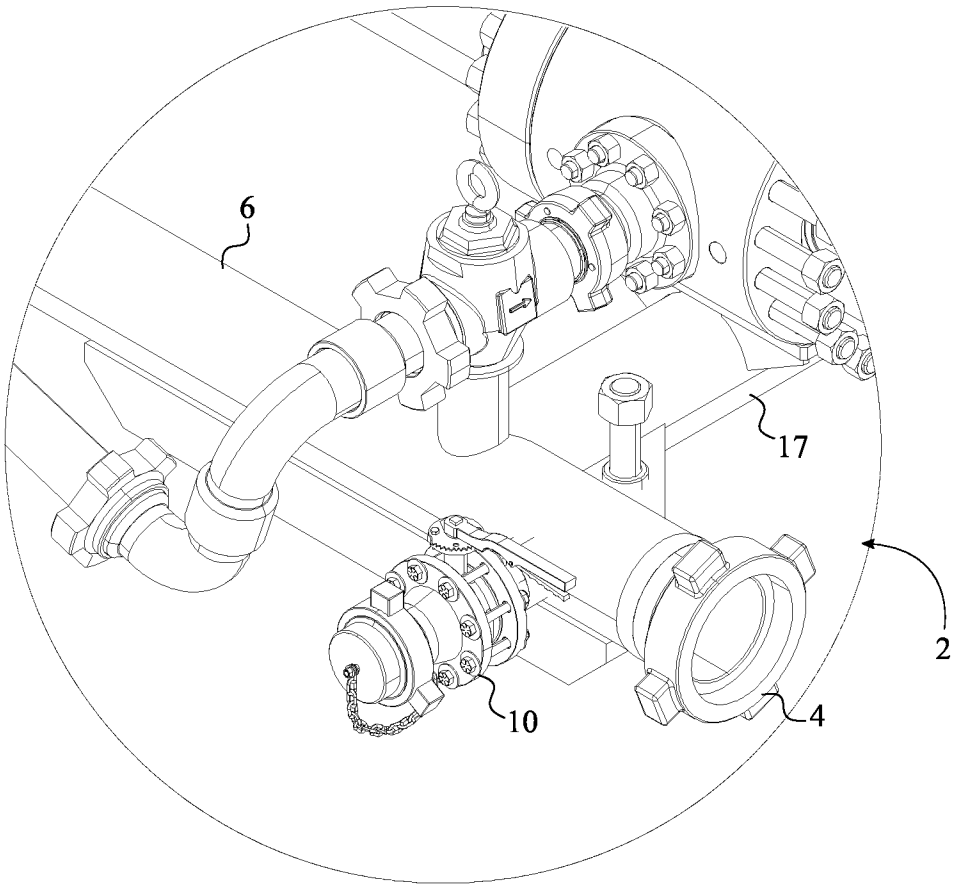
FIG. 7 is a detailed view of the right pipe of the at least one fracturing fluid delivering unit.
Figure 8:
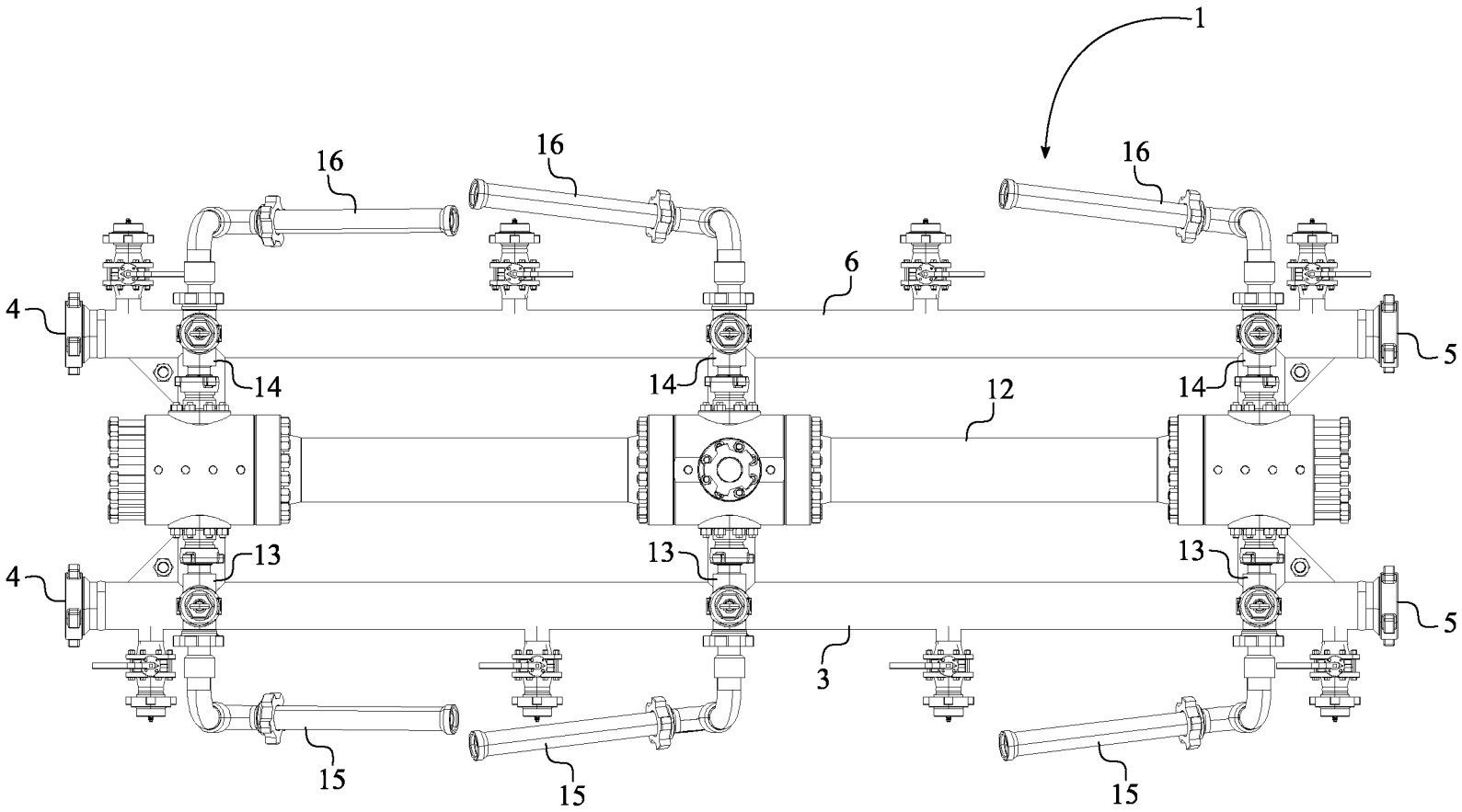
FIG. 8 is a top view of the at least one fracturing fluid delivering unit.

In reference to FIG. 4 and FIG. 6, the left pipe 3 and the right pipe 6 each comprises a first pipe flange 4 and a second pipe flange 5 thus delineating the two ends of the left pipe 3 and the right pipe 6. More specifically, the first pipe flange 4 of the left pipe 3 is positioned coplanar to the first pipe flange 4 of the right pipe 6. The second pipe flange 5 of the left pipe 3 is positioned coplanar to the second pipe flange 5 of the right pipe 6. Furthermore, the plurality of left outlets 9 is evenly distributed in between the first pipe flange 4 and the second pipe flange 5 of the left pipe 3 so that the first set of trucks can be parked next to each other with sufficient spacing. When the plurality of left outlets 9 is not coupled to the pump trucks, each of the plurality of left outlets 9 is closed with a removable cap to keep out any debris, dust, or any other types of harmful elements. The plurality of right outlets 10 is evenly distributed in between the first pipe flange 4 and the second pipe flange 5 of the right pipe 6 so that the second set of trucks can be parked next to each other with sufficient spacing. When the plurality of right outlets 10 is not coupled to the pump trucks, each of the plurality of right outlets 10 is closed with a removable cap to keep out any debris, dust, or any other types of harmful elements. Each corresponding removable cap is tethered to left pipe 3 and the right pipe 6 with a chain or a strap thus preventing the misplacement of the removable cap.

Preferably, each of the plurality of left outlets 9 and each of the plurality of right outlets 10 is equipped or configured with a control valve so that discharging of hydraulic fracturing fluid can be controlled or shut-off during the operation of the present invention.

In order to structurally strengthen the low-pressure flow line assembly 2, the present invention utilizes a schedule 120 steel pipe as the left pipe 3 and the right pipe 6. Furthermore, each of the plurality of cross beams 17 is also made from a schedule 120 steel tubular body. As a result, the present invention can be easily lifted and moved via removable attachments to the low-pressure flow line assembly 2 and the plurality of cross beams 17. Furthermore, the low-pressure flow line assembly 2 is configured as a structural base for the high-pressure flow line assembly 11 as the high-pressure flow line assembly 11 is mounted to the low-pressure flow line assembly 2.

In reference to FIG. 2 and FIG. 8-10, the high-pressure flow line assembly 11 that injects the pressurized hydraulic fracturing fluid from the multiple pump trucks comprises a center pipe 12, a plurality of left inlets 13, a plurality of right inlets 14, a plurality of left extensions 15, and a plurality of right extensions 16. More specifically, the center pipe 12 is centrally positioned along the left pipe 3 and the right pipe 6 so that the center pipe 12 can be mounted to the plurality of cross beams 17. The center pipe 12 functions as the main flow line that discharges the pressurized hydraulic fracturing fluid to the wellhead in order to initiate the hydraulic fracturing.

Figure 9:
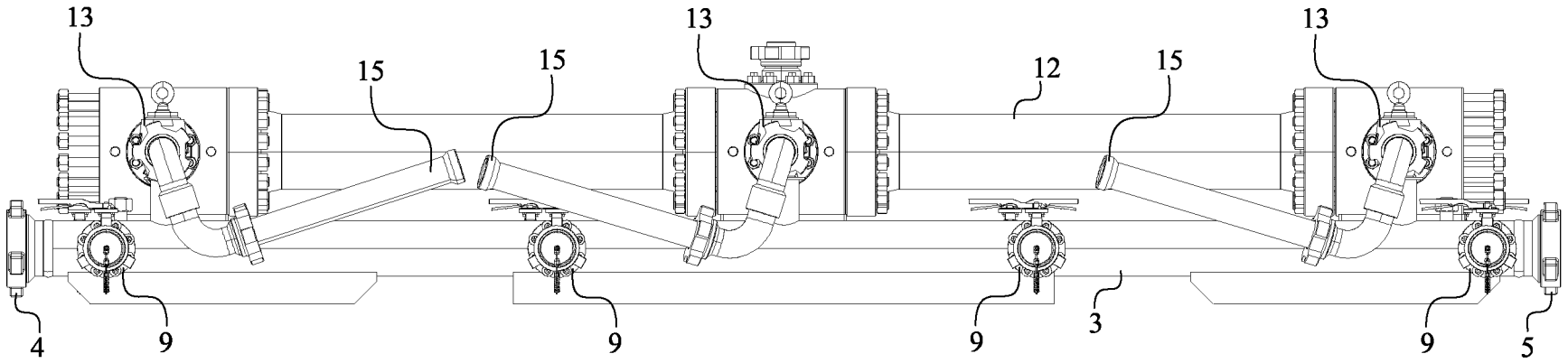
FIG. 9 is a left view of the at least one fracturing fluid delivering unit.

As shown in FIG. 9, the plurality of left inlets 13 is integrated into the center pipe 12. Each of the plurality of left extensions 15 is mounted to a corresponding left inlet from the plurality of left inlets 13. Furthermore, the plurality of left inlets 13 is in fluid communication with the center pipe 12 thus enabling each of the plurality of left extensions 15 to be in fluid communication with the corresponding left inlet from the plurality of left inlets 13. As a result, the first set of pump trucks that is positioned adjacent to the left pipe 3 can continuously supply a steady stream of the pressurized hydraulic fracturing fluid into the center pipe 12 via the plurality of left extensions 15 and the plurality of left inlets 13. In other words, the pressurized hydraulic fracturing fluid from the first set of pump trucks is first discharged into the plurality of left extensions 15, then goes through the plurality of left inlets 13, and into the center pipe 12.

Figure 10:
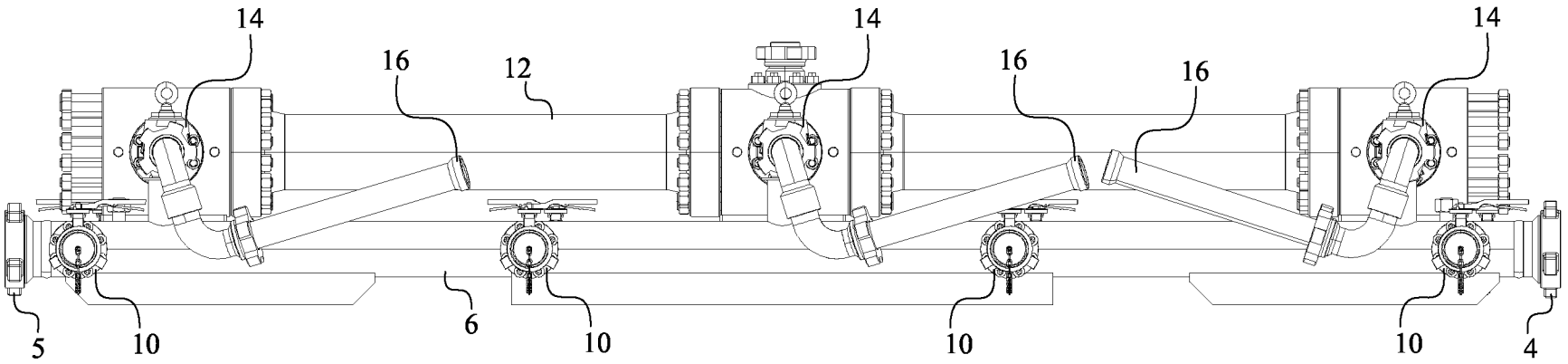
FIG. 10 is a right view of the at least one fracturing fluid delivering unit.

As shown in FIG. 10, the plurality of right inlets 14 is integrated into the center pipe 12. Each of the plurality of right extensions 16 is mounted to a corresponding right inlet from the plurality of right inlets 14. Furthermore, the plurality of right inlets 14 is in fluid communication with the center pipe 12 thus enabling each of the plurality of right extensions 16 to be in fluid communication with the corresponding right inlet from the plurality of right inlets 14. As a result, the second set of pump trucks that is positioned adjacent to the right pipe 6 can continuously supply a steady stream of the pressurized hydraulic fracturing fluid into the center pipe 12 via the plurality of right extensions 16 and the plurality of right inlets 14. In other words, the pressurized hydraulic fracturing fluid from the second set of pump trucks is first discharged into the plurality of right extensions 16, then goes through the plurality of right inlets 14, and into the center pipe 12.

Figure 11:
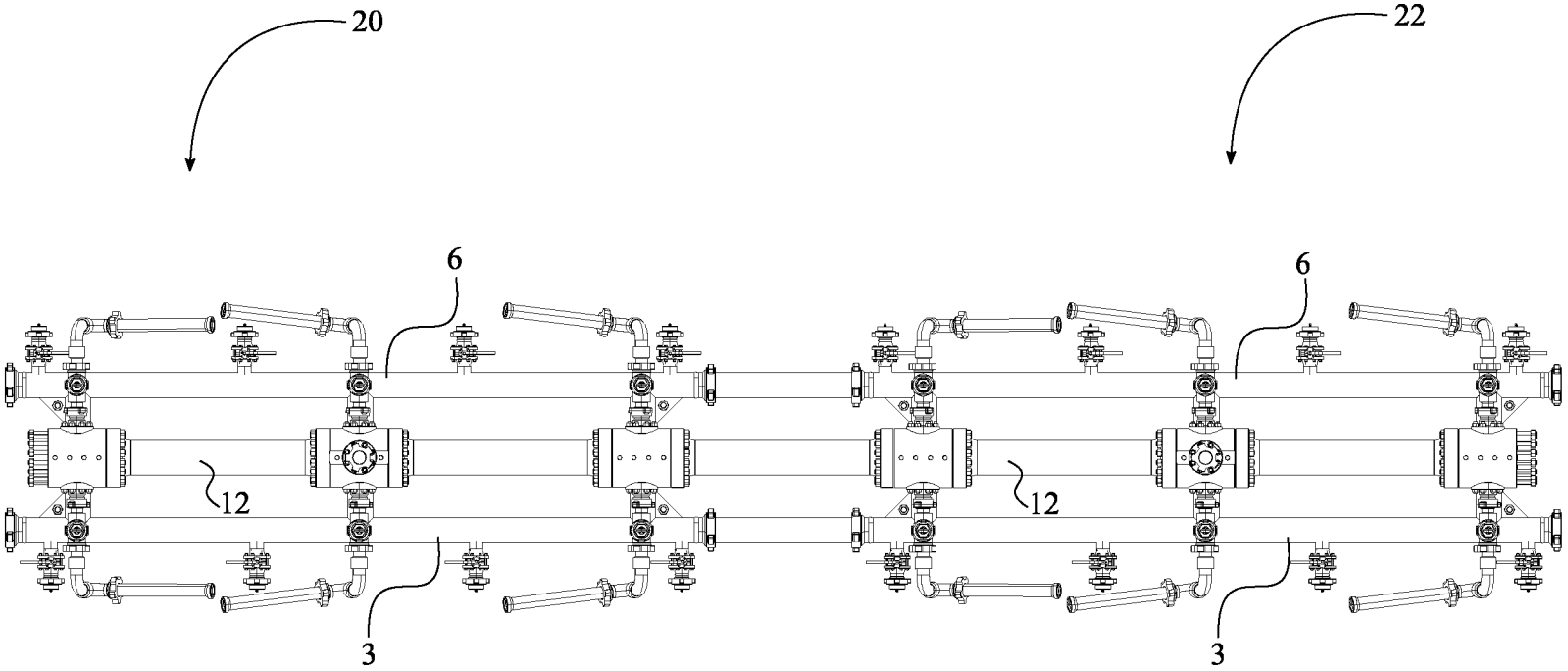
FIG. 11 is an embodiment showing the configuration between two fracturing fluid delivering units in series.

Depending upon the type of field requirements, the at least one fracturing fluid delivering unit 1 comprises a first end unit 20 and a second end unit 22 as shown in FIG. 11. During the assembly of the first end unit 20 and the second end unit 22, the left pipe 3 for the low-pressure flow line assembly 2 of the first end unit 20 is concentrically positioned with the left pipe 3 for the low-pressure flow line assembly 2 of the second end unit 22. The right pipe 6 for the low-pressure flow line assembly 2 of the first end unit 20 is concentrically positioned with the right pipe 6 for the low-pressure flow line assembly 2 of the second end unit 22. The left pipe 3 of the first end unit 20 is in fluid communication with the left pipe 3 of the second end unit 22 via a flexible hose or any other type of similar tubing. The right pipe 6 of the first end unit 20 is in fluid communication with the right pipe 6 of the second end unit 22 via a flexible hose or any other type of similar tubing. The center pipe 12 for the high-pressure flow line assembly 11 of the first end unit 20 is concentrically positioned with the center pipe 12 for the high-pressure flow line assembly 11 of the second end unit 22, as the center pipe 12 of the first end unit 20 is in fluid communication with the center pipe 12 of the second end unit 22. Preferably, the center pipe 12 of the first end unit 20 is mounted to the center pipe 12 of the second end unit 22 via nut and bolt fasteners. As a result, the secure connection between the center pipe 12 of the first end unit 20 and the center pipe 12 of the second end unit 22 is collectively configured as a structural member for the low-pressure flow line assembly 2 of the first end unit 20 and the second end unit 22 so that the aforementioned embodiment can be structurally strengthen.

Figure 12:
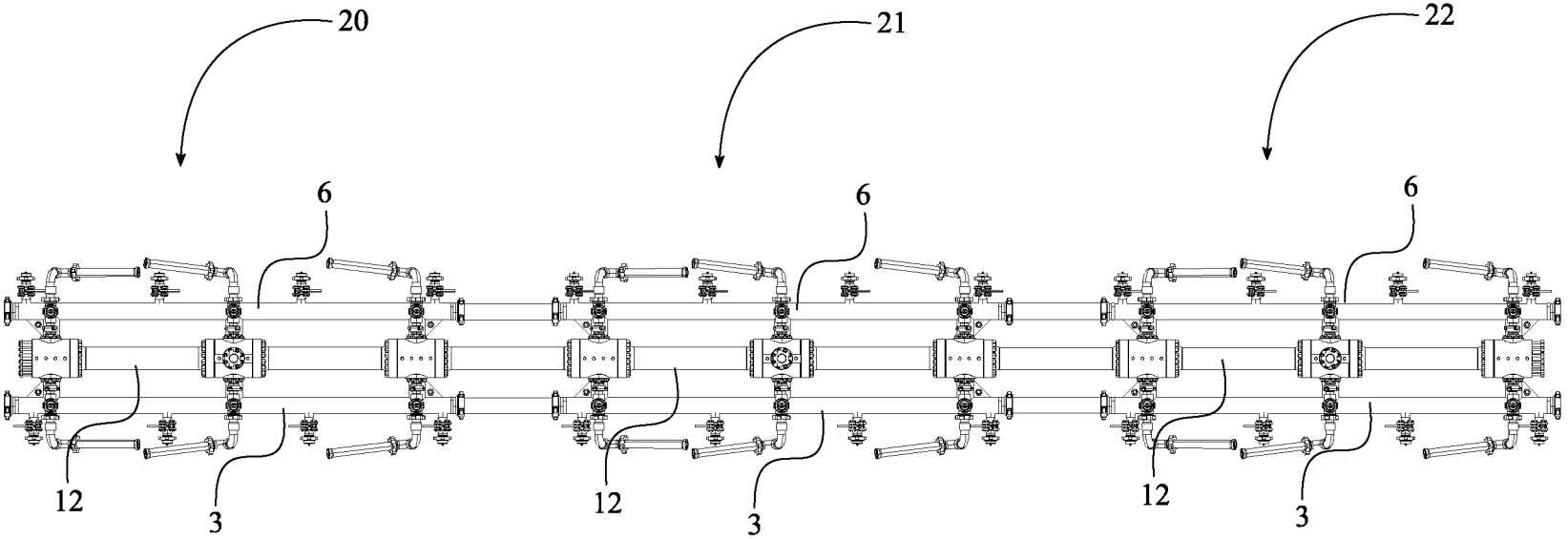
FIG. 12 is an embodiment showing the configuration between three fracturing fluid delivering units in series.

Depending upon the type of field requirements, the at least one fracturing fluid delivering unit 1 comprises the first end unit 20, the second end unit 22, and at least one intermediate unit 21 as shown in FIG. 12. During the assembly of the first end unit 20, the intermediate unit 21, and the second end unit 22, the left pipe 3 for the low-pressure flow line assembly 2 of the intermediate unit 21 is concentrically positioned in between the left pipe 3 for the low-pressure flow line assembly 2 of the first end unit 20 and the second end unit 22. Similarly, the right pipe 6 for the low-pressure flow line assembly 2 of the intermediate unit 21 is concentrically positioned in between the right pipe 6 for the low-pressure flow line assembly 2 of the first end unit 20 and the second end unit 22. The left pipe 3 of the first end unit 20 is in fluid communication with the left pipe 3 of the second end unit 22 through the left pipe 3 of the intermediate unit 21. Preferably, a flexible hose or any other type of similar tubing is utilized to complete the in fluid communication of the left pipe 3 for the first end unit 20, the intermediate unit 21, and the second end unit 22. The right pipe 6 of the first end unit 20 is in fluid communication with the right pipe 6 of the second end unit 22 through the right pipe 6 of the intermediate unit 21. Preferably, a flexible hose or any other type of similar tubing is utilized to complete the in fluid communication of the right pipe 6 for the first end unit 20, the intermediate unit 21, and the second end unit 22. The center pipe 12 for the high-pressure flow line assembly 11 of the intermediate unit 21 is concentrically positioned in between the center pipe 12 for the high-pressure flow line assembly 11 of the first end unit 20 and the second end unit 22. Furthermore, the center pipe 12 of the first end unit 20 is in fluid communication with the center pipe 12 of the second end unit 22 through the center pipe 12 of the intermediate unit 21. More specifically, the center pipe 12 of the first end unit 20 is mounted to the center pipe 12 of the intermediate unit 21 via nut and bolt fasteners. The center pipe 12 of the second end unit 22 is mounted to the center pipe 12 of the intermediate unit 21 via nut and bolt fasteners, opposite of the center pipe 12 of the first end unit 20. As a result, the center pipe 12 of the first end unit 20, the center pipe 12 of the intermediate unit 21, and the center pipe 12 for the second end unit 22 are collectively configured as a structural member for the low-pressure flow line assembly 2 of the first end unit 20, the intermediate unit 21, and the second end unit 22 so that the aforementioned embodiment can be structurally strengthen.

Figure 13:
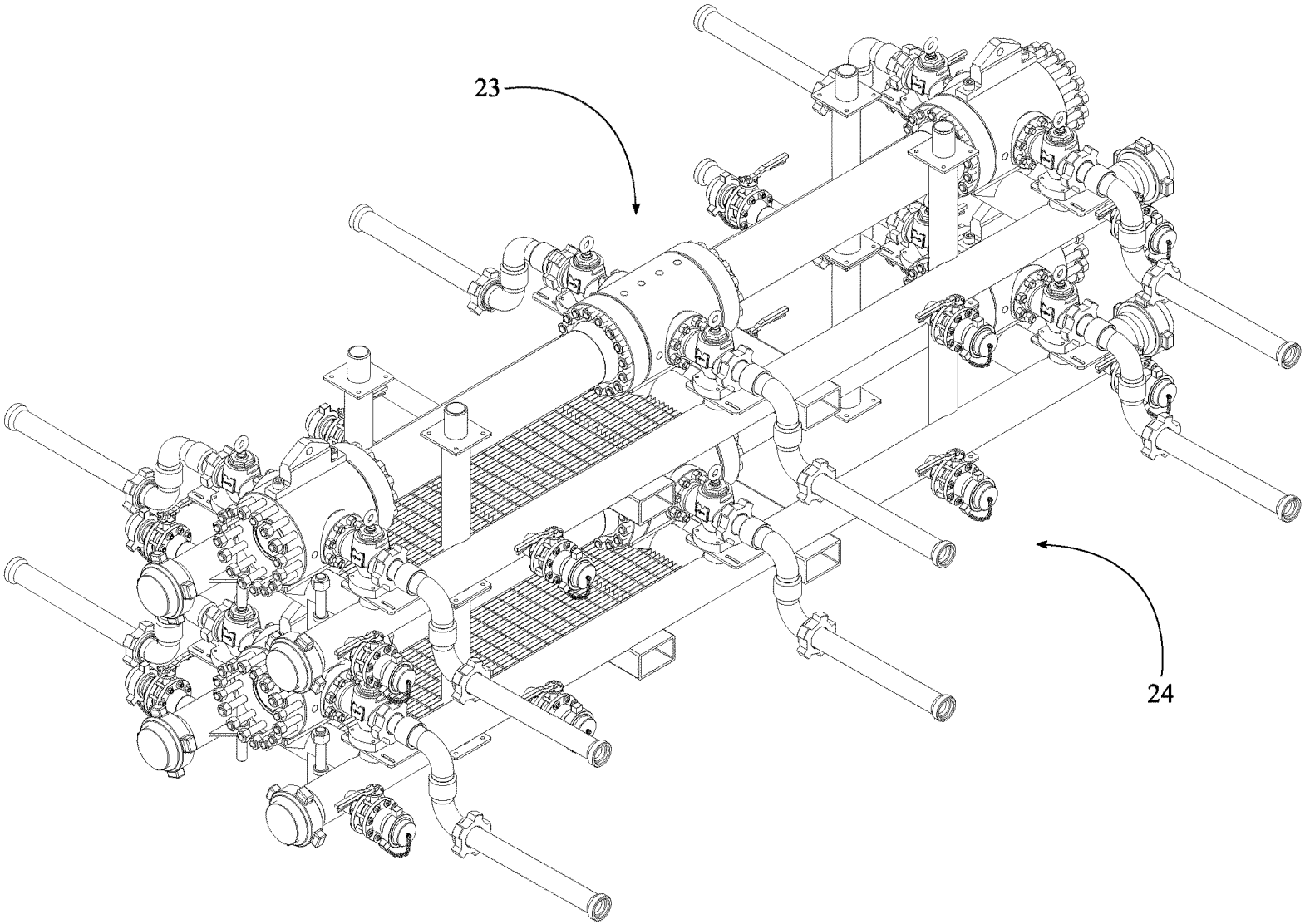
FIG. 13 is an embodiment showing the configuration between two fracturing fluid delivering units in parallel.

Depending upon the type of field requirements, the at least one fracturing fluid delivering unit 1 comprises a top unit 23 and a bottom unit 24 as shown in FIG. 13. More specifically, the left pipe 3 for the low-pressure flow line assembly 2 of the top unit 23 is positioned atop and parallel to the left pipe 3 for the low-pressure flow line assembly 2 of the bottom unit 24. The right pipe 6 for the low-pressure flow line assembly 2 of the top unit 23 is positioned atop and parallel to the right pipe 6 for the low-pressure flow line assembly 2 of the bottom unit 24. The center pipe 12 for the high-pressure flow line assembly 11 of the top unit 23 is positioned atop and parallel to the center pipe 12 for the high-pressure flow line assembly 11 of the bottom unit 24. In other words, the top unit 23 is stackable on the bottom unit 24 for field use, transportation, and storage.

Although the invention has been explained in relation to its preferred embodiment, it is to be understood that many other possible modifications and variations can be made without departing from the spirit and scope of the invention as hereinafter claimed.

What is claimed is:

1. A fracturing fluid delivering system comprising:

at least one fracturing fluid delivering unit;

the at least one fracturing fluid delivering unit comprising a low-pressure flow line assembly, a high-pressure flow line assembly, and a plurality of cross beams;

the plurality of cross beams being evenly spaced along the low-pressure flow line assembly;

the plurality of cross beams being welded onto the low-pressure flow line assembly;

the high-pressure flow line assembly being positioned atop the plurality of cross beams;

the high-pressure flow line assembly being mounted to the plurality of cross beams; and the low-pressure flow line assembly being configured as a structural base for the high-pressure flow line assembly.

2. The fracturing fluid delivering system as claimed in claim 1 comprising:

the low-pressure flow line assembly comprising a left pipe, a right pipe, a plurality of left outlets, and a plurality of right outlets;

the plurality of cross beams being positioned parallel and offset from each other;

the left pipe being positioned perpendicular to the plurality of cross beams;

the plurality of cross beams being terminally welded onto the left pipe;

the right pipe being positioned perpendicular to the plurality of cross beams;

the plurality of cross beams being terminally welded onto the right pipe, opposite of the left pipe;

the plurality of left outlets being integrated into the left pipe;

the plurality of right outlets being integrated into the right pipe;

the plurality of left outlets being in fluid communication with the left pipe; and the plurality of right outlets being in fluid communication with the right pipe.

3. The fracturing fluid delivering system as claimed in claim 2 comprising:

the left pipe and the right pipe each comprising a first pipe flange and a second pipe flange;

the first pipe flange of the left pipe being positioned coplanar to the first pipe flange of the right pipe;

the second pipe flange of the left pipe being positioned coplanar to the second pipe flange of the right pipe;

the plurality of left outlets being evenly distributed in between the first pipe flange and the second pipe flange of the left pipe; and the plurality of right outlets being evenly distributed in between the first pipe flange and the second pipe flange of the right pipe.

4. The fracturing fluid delivering system as claimed in claim 2, wherein the left pipe is a steel pipe.

5. The fracturing fluid delivering system as claimed in claim 2, wherein the right pipe is a steel pipe.

6. The fracturing fluid delivering system as claimed in claim 1, wherein each of the plurality of cross beams is a steel tubular body.

7. The fracturing fluid delivering system as claimed in claim 1 comprising:

the high-pressure flow line assembly comprising a center pipe, a plurality of left inlets, a plurality of right inlets, a plurality of left extensions, and a plurality of right extensions;

the center pipe being centrally positioned along a left pipe and a right pipe of the low-pressure flow line assembly;

the center pipe being mounted to the plurality of cross beams;

the plurality of left inlets being integrated into the center pipe;

the plurality of right inlets being integrated into the center pipe;

the plurality of left inlets being in fluid communication with the center pipe;

the plurality of right inlets being in fluid communication with the center pipe;

each of the plurality of left extensions being mounted to a corresponding left inlet from the plurality of left inlets;

each of the plurality of right extensions being mounted to a corresponding right inlet from the plurality of right inlets;

each of the plurality of left extensions being in fluid communication with the corresponding left inlet from the plurality of left inlets; and each of the plurality of right extensions being in fluid communication with the corresponding right inlet from the plurality of right inlets.

8. The fracturing fluid delivering system as claimed in claim 1 comprising:

the at least one fracturing fluid delivering unit comprising a first end unit and a second end unit;

a left pipe for the low-pressure flow line assembly of the first end unit being concentrically positioned with a left pipe for the low-pressure flow line assembly of the second end unit;

a right pipe for the low-pressure flow line assembly of the first end unit being concentrically positioned with a right pipe for the low-pressure flow line assembly of the second end unit;

the left pipe of the first end unit being in fluid communication with the left pipe of the second end unit;

the right pipe of the first end unit being in fluid communication with the right pipe of the second end unit;

a center pipe for the high-pressure flow line assembly of the first end unit being concentrically positioned with a center pipe for the high-pressure flow line assembly of the second end unit; and the center pipe of the first end unit being in fluid communication with the center pipe of the second end unit.

9. The fracturing fluid delivering system as claimed in claim 8 comprising:

the center pipe of the first end unit being mounted to the center pipe of the second end unit; and the center pipe of the first end unit and the center pipe of the second end unit being collectively configured as a structural member for the low-pressure flow line assembly of the first end unit and the second end unit.

10. The fracturing fluid delivering system as claimed in claim 1 comprising:

the at least one fracturing fluid delivering unit comprising a first end unit, at least one intermediate unit, and a second end unit;

a left pipe for the low-pressure flow line assembly of the intermediate unit being concentrically positioned in between a left pipe for the low-pressure flow line assembly of the first end unit and the second end unit;

a right pipe for the low-pressure flow line assembly of the intermediate unit being concentrically positioned in between a right pipe for the low-pressure flow line assembly of the first end unit and the second end unit;

the left pipe of the first end unit being in fluid communication with the left pipe of the second end unit through the left pipe of the intermediate unit;

the right pipe of the first end unit being in fluid communication with the right pipe of the second end unit through the right pipe of the intermediate unit;

a center pipe for the high-pressure flow line assembly of the intermediate unit being concentrically positioned in between a center pipe for the high-pressure flow line assembly of the first end unit and the second end unit; and the center pipe of the first end unit being in fluid communication with the center pipe of the second end unit through the center pipe of the intermediate unit.

11. The fracturing fluid delivering system as claimed in claim 10 comprising:

the center pipe of the first end unit being mounted to the center pipe of the intermediate unit;

the center pipe of the second end unit being mounted to the center pipe of the intermediate unit, opposite of the center pipe of the first end unit; and the center pipe of the first end unit, the center pipe of the intermediate unit, and the center pipe for the second end unit being collectively configured as a structural member for the low-pressure flow line assembly of the first end unit, the intermediate unit, and the second end unit.

12. The fracturing fluid delivering system as claimed in claim 1 comprising:

the at least one fracturing fluid delivering unit comprising a top unit and a bottom unit;

a left pipe for the low-pressure flow line assembly of the top unit being positioned atop a left pipe for the low-pressure flow line assembly of the bottom unit;

a right pipe for the low-pressure flow line assembly of the top unit being positioned atop a right pipe for the low-pressure flow line assembly of the bottom unit; and a center pipe for the high-pressure flow line assembly of the top unit being positioned atop a center pipe for the high-pressure flow line assembly of the bottom unit.

13. The fracturing fluid delivering system as claimed in claim 12, wherein the top unit being stackable on the bottom unit for field use, transportation, and storage.

* * * * *